US006289978B1

(12) United States Patent
Antoine

(10) Patent No.: US 6,289,978 B1
(45) Date of Patent: Sep. 18, 2001

(54) COILED HEAT EXCHANGER AND A METHOD FOR MAKING A COILED HEAT EXCHANGER

(75) Inventor: Hubert Antoine, Esneux (BE)

(73) Assignee: Ateliers de Construction de Thermo-Echangeurs SA, Ans (BE)

( * ) Notice: Subject to any disclaimer, the term of this patent is extended or adjusted under 35 U.S.C. 154(b) by 0 days.

(21) Appl. No.: 09/436,353

(22) Filed: Nov. 9, 1999

(51) Int. Cl.[7] ..... F28D 9/04

(52) U.S. Cl. ..... 165/165; 165/164; 165/DIG. 398; 29/890.03

(58) Field of Search ..... 165/164, 165, 165/DIG. 398; 29/890.03

(56) References Cited

U.S. PATENT DOCUMENTS

| | | | | |
|---|---|---|---|---|
| 2,663,549 | * | 12/1953 | Otten | 165/398 |
| 3,507,115 | | 4/1970 | Wisoka . | |
| 3,854,530 | * | 12/1974 | Jouet et al | 165/163 |
| 3,893,509 | | 7/1975 | Satchwell et al. . | |
| 4,073,340 | | 2/1978 | Parker | 165/166 |
| 4,089,370 | | 5/1978 | Marchal . | |
| 4,124,069 | | 11/1978 | Becker . | |
| 4,546,826 | | 10/1985 | Zitzmann . | |
| 5,273,106 | * | 12/1993 | Drake | 165/96 |
| 5,505,255 | * | 4/1996 | Viessmann | 165/164 |
| 5,797,449 | | 8/1998 | Oswald et al. | 165/165 |

FOREIGN PATENT DOCUMENTS

| | | |
|---|---|---|
| 588741 | 11/1933 | (DE) . |
| 11 21 090 | 1/1962 | (DE) . |
| 32 34 878 | 3/1984 | (DE) . |
| 0 798 527 | 10/1997 | (EP) . |
| 1058090 | 3/1954 | (FR) . |
| 2 319 868 | 2/1977 | (FR) . |
| 2559249 | 9/1985 | (FR) . |
| 291593 | 6/1928 | (GB) . |
| 892962 | 4/1962 | (GB) . |
| 98/05916 | 2/1998 | (WO) . |

OTHER PUBLICATIONS

E. L. Parsons, Solar Turbines, Inc., San Diego, California; SAE Technical Paper Series 851254; "Development, Fabrication and Application of a Primary Surface Gas Turbine Recuperator,"; Government/Industry Meeting & Exposition, Washington, D.C., May 20–23, 1985.

* cited by examiner

*Primary Examiner*—Allen Flanigan
(74) *Attorney, Agent, or Firm*—Finnegan, Henderson, Farabow, Garett & Dunner, L.L.P.

(57) ABSTRACT

A coiled heat exchanger and a method of making the coiled heat exchanger. The heat exchanger includes a pair of corrugated plates connected to one another such that the crests of their respective corrugations contact. Edges of the sheets that correspond to the faces of the cylindrical core formed from coiling the sheets are bent and connected such that a substantially continuous and flat wall is formed between the two sheets. Portions of the wall are alternately cut open, left intact, and flattened so as to form a pattern of three distinct angular sectors on the face of the core. These angular sectors respectively include cut-open sectors configured to pass a heat transfer fluid therethrough, platform sectors configured for the mounting of headers thereon, and flattened wall sectors creating gaps configured to pass a heat transfer fluid therethrough. The heat exchanger is formed in a continuous process, with the edges connected to form the wall along the entire length of the sheets forming the coil and periodic portions of the wall flattened along the length. The sheets are then coiled and fixedly connected between their coils at particular locations. Finally, wall portions are cut open in periodic angular intervals on the core face to form the openings.

28 Claims, 4 Drawing Sheets

COILED HEAT EXCHANGER AND A METHOD FOR MAKING A COILED HEAT EXCHANGER

FIELD OF THE INVENTION

The present invention relates to coiled heat exchangers having a spiral configuration. In these types of heat exchangers, heat transfer fluids enter, circulate, and exit the heat exchanger in a counterflow manner in a direction substantially parallel to the coil's longitudinal axis.

BACKGROUND OF THE INVENTION

Though numerous applications utilize coiled heat exchangers, the gas turbine recuperator is among the most demanding. In any application, and especially when used as a gas turbine recuperator, the heat exchanger should be compact, efficient, reliable, and relatively inexpensive to manufacture. By designing the primary heat transfer surface with small hydraulic diameters and counterflow circulation of heat transfer fluids, a relatively compact and efficient heat exchanger can be obtained. Furthermore, providing the heat exchanger with relatively large cross-sectional flow areas reduces load losses. Achievement of large cross-sectional flow areas in coiled heat exchangers requires circulating heat transfer fluids in the axial, as opposed to tangential, direction. Additionally, production costs can be lowered by minimizing the number of elements used to make the heat exchanger and by forming and coiling the heat exchanger in a continuous process. Another design consideration, especially when used as a gas turbine recuperator, includes resistance to thermal shock. Heavy thermal loads often result from the transient operation of turbines. Therefore, to ensure reliable performance and operation, the heat exchanger should have high resistance to Various known heat exchangers are made from coiling a pair of sheets between which heat transfer fluids circulate in a counterflow manner in directions substantially parallel to the longitudinal axis of the coil. For example, U.S. Pat. No. 5,797,449 pertains to an annular heat exchanger formed by a pair of sheets welded together and coiled, with openings cut through the sheets through which heat transfer fluid passes.

German patents DE 1121090 and DE 3234878 describe spiral heat exchangers having axially circulated fluid flows, in which the fluids enter and exit through alternating angular sectors. In DE 1121090, sectors for circulating the heat transfer fluids are formed by cutting evenly-spaced openings in borders that close the edges of a pair of sheets coiled to form the heat exchanger. After the borders are cut, the two sheets are coiled to form the heat exchanger. DE 1121090 additionally discloses the fabrication of the spiral heat exchangers with external headers.

In DE 3234878, the sectors are formed by glueing blocking segments on the two faces of the coiled heat exchanger.

Finally, in French patent document FR-A-231 9868, borders are closed by the direct welding of adjacent sheets.

A particular difficulty in heat exchangers having a coiled configuration includes the distribution of the single incoming flow into the myriad of small heat transfer passages and the collection of the same into a single outgoing flow after the heat transfer has taken place. Preferably, this distributing and collecting should not result in excessive head losses, nor should it cause mechanical stresses due to large thermal gradients. Another difficulty arises from blockages to the heat transfer fluids that exist on the core face as the result of the particular construction used for the heat exchanger.

For instance, in one known example, the sheets are constructed and cut such that one sheet has openings only for one fluid and the other has openings only for the other fluid. This leads to a relatively high amount of fluid being blocked at the core faces, thus reducing gas flow passage and overall efficiency of the heat exchanger.

Stacked plate heat exchangers often include openings cut in the plates to distribute and collect the heat transfer fluids. The edges of these openings generally are either brazed or welded together during assembly of the heat exchanger (for example in U.S. Pat. No. 4,073,340) or are fitted with a gasket (for example in Alfa-Laval plate heat exchangers). Other stacked plate heat exchangers do not include such openings (see SAE 851254. "Development, Fabrication, and Application of a Primary Surface Gas Turbine Recuperator", E. L. Parsons), but the sides of the plates must be provided with sealing bars.

Also important in constructing a coiled heat exchanger is the connection of the external headers with the core. The header-to-core connection must be sealed to prevent leakage of heat transfer fluids being passed to the heat exchanger core. Furthermore, headers should have the strength to resist forces tending to pull them away from the core due to the relatively high pressures experienced as fluids are collected and distributed and to inertial forces resulting from supporting the core weight. Additionally, temperature gradients occurring between the core and the header can result due to sudden transient temperatures in one of the heat transfer fluids combined with the relative thermal inertia of the core and the headers. Such gradients may cause thermal expansion forces on headers. Therefore, construction of the heat exchanger needs to account for these effects as well.

SUMMARY OF THE INVENTION

The advantages and purpose of the invention will be set forth in part in the description which follows, and in part will be obvious from the description, or may be learned by practice of the invention. The advantages and purpose of the invention will be realized and attained by means of the elements and combinations particularly pointed out in the appended claims.

To attain the advantages and in accordance with the purpose of the invention, as embodied and broadly described herein, the invention includes a heat exchanger formed by coiling a pair of sheets. The heat exchanger includes a first sheet having an edge and a second sheet having an edge. The first and second sheets are connected to each other along their respective edges such that the edges form a substantially flat wall. The wall formed by connecting the first and second sheet edges includes a first set of openings formed by cutting the wall and a second set of openings formed by flattening the wall.

Another aspect of the present invention includes a method for forming a coiled heat exchanger. The method includes providing a first sheet and a second sheet and connecting the sheets to each other along edges of the sheets such that the edges form a substantially flat wall between surfaces of the sheets. The method further includes reducing a thickness of the wall along periodic intervals of the length of the connected sheets. The sheets are then coiled to form a cylindrical core, with the core having a face formed by the wall. Finally, the method includes removing portions of the wall on the face of the core.

BRIEF DESCRIPTION OF THE DRAWINGS

The accompanying drawings, which are incorporated in and constitute a part of this specification, illustrate the preferred embodiments of the invention and, together with the description, serve to explain the principles of the invention. In the drawings.

DETAILED DESCRIPTION OF THE PREFERRED EMBODIMENT

The present invention relates to a heat exchanger formed by coiling a pair of sheets. The heat transfer fluids flow in a counterflow direction to one another, substantially parallel to the longitudinal axis of the coil. The fluids enter and exit the heat exchanger at opposite faces of the cylinder formed by coiling the sheets. By providing entry and exit in this manner, distributing openings need not be disposed inside the heat exchanger. As a result of eliminating these distributing openings, stress concentrations, welding problems, and difficulties with inspection and repair on juncture lines within the heat exchanger are reduced. In addition, the size and shape of the distributor can vary as desired for a particular application since they are entirely external to the heat exchanger core, that is, the cylinder formed by coiling the sheets.

The coiled heat exchanger according to the present invention also eliminates the need to provide sealing bars because no open edges exist. Using the coiling technique, which will be described shortly, facilitates the creation of heat transfer fluid entry and exit passages. Moreover, the inventive connection of the two plates used to form the coiled heat exchanger core allows for high throughflow rates at the core faces and provides an improved connection for external headers onto the faces of the core.

Figure 1:
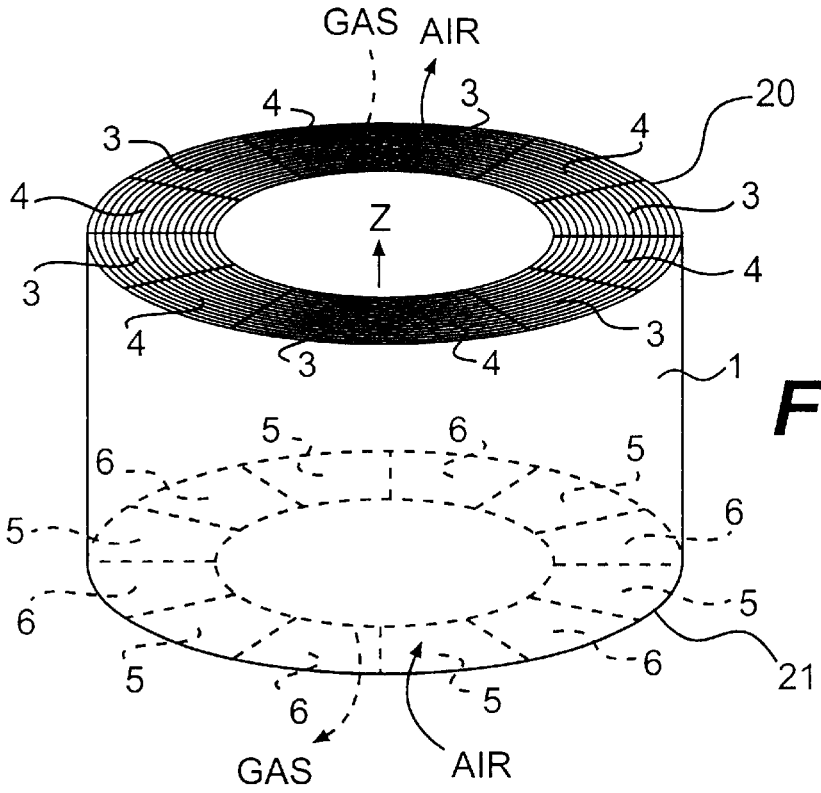
FIG. 1 is a perspective view of the heat exchanger according to an embodiment of the present invention, with arrows indicating incoming and outgoing heat transfer fluid flows.
Figure 3:
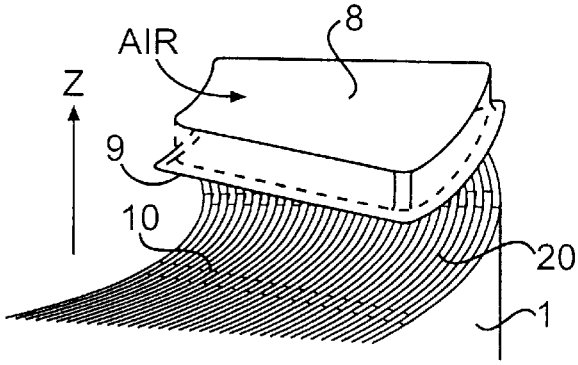
FIG. 3 is an exploded view of an angular air inlet sector with its distribution header according to an embodiment of the present invention.

As shown in FIG. 1, the heat exchanger of the present invention forms a core 1 having a cylindrical configuration. Heat exchanger core 1 is made by coiling a pair of sheets a and b together, as will be explained shortly. External headers 8 attach to a first face 20 of core 1, as shown in FIG. 3.

On a second face 21 of the core, a first heat transfer fluid, such as air, flows in through angular sectors 5, which are evenly spaced around second face 21 in an alternating pattern with angular sectors 6. Angular sectors 6 exit a heat transfer gas through second face 21 of core 1. On first face 20, angular sectors 3 and 4 correspond to angular sectors 5 and 6, respectively. Angular sectors 3 exit air from first face 20 of core 1 while angular sectors 4 intake gas to pass through core 1.

Figure 4:
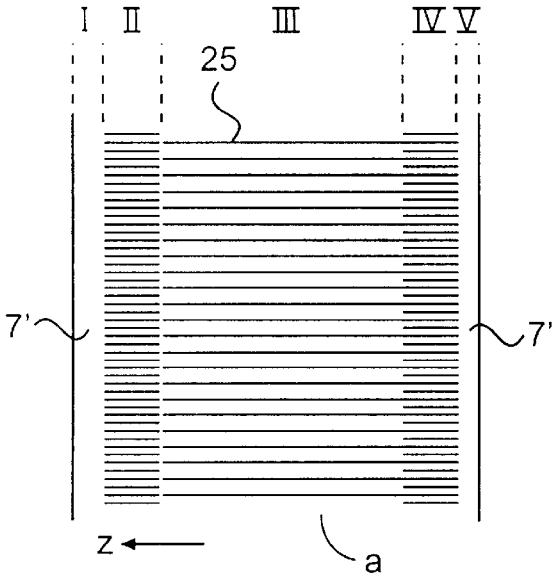
FIG. 4 is a plan partial view of one of the sheets (sheet a) before coiling, sheet a having a corrugated surface with corrugations extending parallel to the longitudinal axis of the heat exchanger core.
Figure 5:
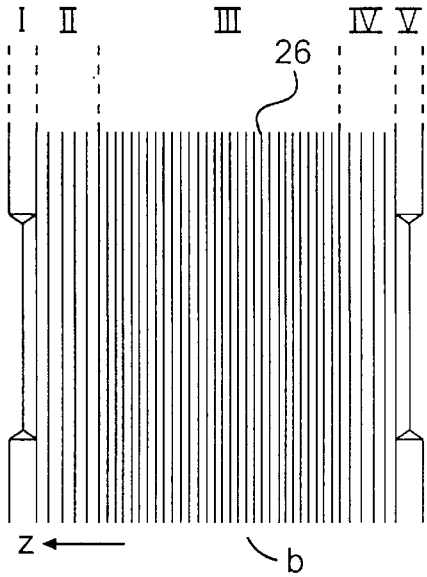
FIG. 5 is a plan partial view of one of the sheets (sheet b) before coiling, sheet b having a corrugated surface with corrugations extending perpendicularly to the longitudinal axis of the heat exchanger core.

Sheets a and b forming heat exchanger core 1 have surfaces as shown best in FIGS. 4 and 5. That is, sheet a includes ripples 25 that extend essentially transverse to the sheet and are substantially parallel to the longitudinal axis (or coiling axis) of the heat exchanger core, i.e., the z-axis in FIGS. 4 and 5, once the sheets have been coiled. Ripples 25 form three zones, zones II and IV along the edges of sheet a and zone III in a central region of sheet a. Ripples in zones II and IV are relatively closely-spaced together and have lengths that extend a relatively short distance from respective edges 7' of sheet a. Ripples in zone III on the other hand have greater distances between them and extend the entire region from zone II to zone IV. In fact, as shown in FIG. 4, these ripples can align with some ripples in zones II and IV to create a smooth transition between zone III and zones II and IV, respectively. Zones I and V on sheet a have no ripples and form edges 7' of the sheet.

Figure 2:
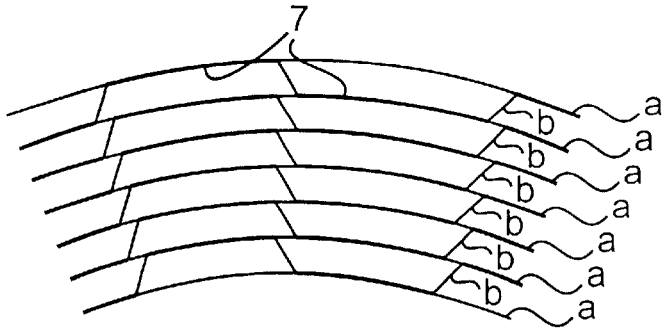
FIG. 2 is a cross-sectional view of a portion of the heat exchanger taken in a plane perpendicular to the longitudinal axis and showing the stacks of coils formed by coiling two sheets a and b of the heat exchanger according to an embodiment of the present invention.

As shown in FIG. 5, sheet b includes ripples 26 that extend essentially longitudinal to the sheet and are substantially perpendicular to the coiling axis after the sheets have been coiled to form the core. The ripples of sheet b also are disposed on zones II through IV corresponding to the zones of sheet a such that the respective zones align when the two plates are laid over one another. Ripples 26 extend the entire length of sheet b. Zones I and V forming edges 7 of sheet b are alternately depressed and raised in a direction parallel to ripples 26. When sheet b is put together with sheet a, as shown in FIG. 2, these alternately raised and depressed regions form the openings for fluid entry and exit. Thus, the raised and depressed edges 7 of sheet b abut edge 7' of sheet a during the coiling operation. After the entire heat exchanger core has been formed by the coiling of sheets a and b, the edges 7 and 7' are brazed together.

Formation of the alternating raised and depressed edge 7 of sheet b preferably is accomplished during the coiling of the two sheets. In order to form well-defined angular sectors of appropriate size, the raising and depressing of edge 7 should be carefully synchronized with the coiling process such that the inlets and outlets that are formed increase in length after each coiling turn and are in angular phase with one another.

Figure 6:
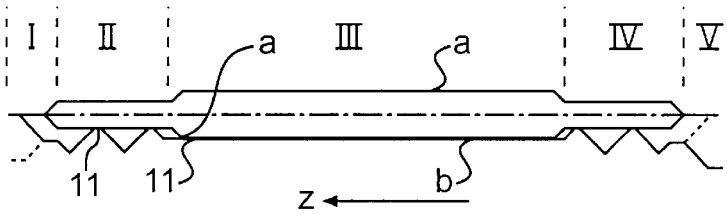
FIG. 6 is a radial sectional view of a pair of sheets assembled together to form a heat exchanger according to one embodiment of the present invention.

The sum of the height of ripples 25 and 26 on sheets a and b remains constant throughout zones II through IV. The summed height should be equal to the variation of height of sheet b in zones I and V so that the thickness of the pair of plates remains constant, as shown in FIG. 6. By maintaining a constant thickness, radial deformation resulting from coiling sheets a and b can be avoided.

Sheets a and b join together along the crests of ripples 25 and 26 and contact at points 11 as shown in FIG. 6. Contact points 11 essentially form a cross-ruling pattern at the intersection of the ripple crest lines. Joining the portions of the pair of sheets that circulate the higher pressure fluid therebetween, achieves a local containment of that fluid overpressure. This eliminates the need to provide a pressure vessel. Such joining preferably is accomplished by brazing, however other suitable like joining techniques may also be used.

Figure 7:
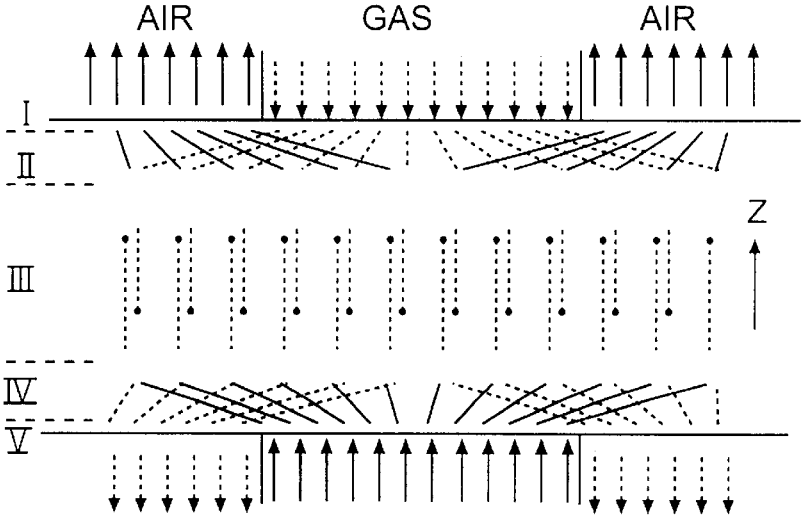
FIG. 7 is a plan partial view of the paths of air and gas between a pair of sheets, from one face of the heat exchanger to the other.

Ripples 25 and 26 in zones II and IV of both sheets a and b have similar heights. These ripples contact each other at their crests as explained with reference to FIG. 6 and lie essentially perpendicular to one another. Due to the relative configurations and orientations of ripples 25 and 26, zones II and IV enable the heat transfer fluids, for example air and gas, to pass in both axial and tangential directions, as shown in FIG. 7. Zones II and IV therefore essentially serve as distributing or collecting zones to initially distribute and ultimately collect the fluid flowing through heat exchanger core 1. As indicated by the arrows in FIG. 7, zones II and IV essentially provide for a cross-flow of the two heat transfer fluids circulating through the heat exchanger.

After distribution in zones II and IV, the fluid flows are directed into zone III. As a result of the relatively large axially-directed ripples 25 on sheet a and the relatively small tangential ripples 26 on sheet b, as well as the relative spacings between the ripples, the flow occurs substantially parallel to the coiling axis of core 1. The heat transfer fluid flows encounter each other in a counterflow manner due their respective entries at opposite faces of core 1, as was described with reference to FIG. 1.

After core 1 has been formed with the above-described coiling process, headers 8 can be fixed to the core faces. Headers 8 are aligned with angular sectors as shown in FIG. 3 and their rims 9 fixed to the edges 10 forming the angular sectors. Brazing the headers to the core faces represents one technique that may be employed to fix the headers to the core, however other suitable joining techniques are also contemplated by the invention.

Another embodiment of the heat exchanger according to the present invention is shown in FIGS. 8–12. An aspect of this embodiment includes forming side walls along respective edges 7' and 7 of sheets a and b and connecting the side walls such that the coiled pair of sheets a and b form sealed passages that do not permit leakage between the two heat transfer fluids flowing through the sectors of the heat exchanger. A further aspect of this embodiment of the heat exchanger includes the formation of surfaces on the faces of core 1 that provide a strong and stable connection for headers 8 to core 1. With the exception of the connection of sheets a and b along their respective edges 7' and 7 as will be described, sheets a and b are configured and connect in essentially the same manner as discussed with reference to FIGS. 1–7. That is, sheets a and b include ripples 25 and 26 connected at points of contacts of the crests of each set of ripples. However, the ripples in FIGS. 8–12 have not been shown.

In FIGS. 8–11, the connection of sheets a and b along edges 7' and 7 is shown according to an embodiment of the invention. Rather than the flat edge 7' of sheet a connected with the alternately raised and depressed edge 7 of sheet b, the edges 7 and 7' (forming both faces of core 1) are bent and folded over one another in the manner shown best in FIG. 9. The bent edges 7 and 7' are then fixedly connected to one another, preferably by seam-welding or other suitable connection technique, at 70 to form an essentially flat and continuous side wall 80. Though FIGS. 8–11 show a number of stacked coils resulting from coiling the pair of plates to form core 1, the connection of edges 7' and 7 along sheets a and b in this manner occurs prior to coiling the sheets.

Figure 8:
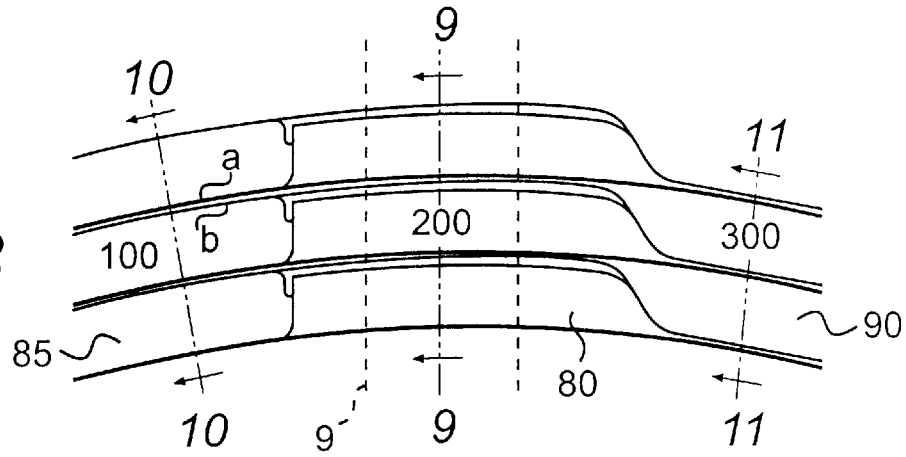
FIG. 8 is a partial front view of a core face of another embodiment of the heat exchanger according to the present invention, showing a few coil stacks and the three cut-open, platform, and flattened gap-forming angular sectors.
Figure 9:
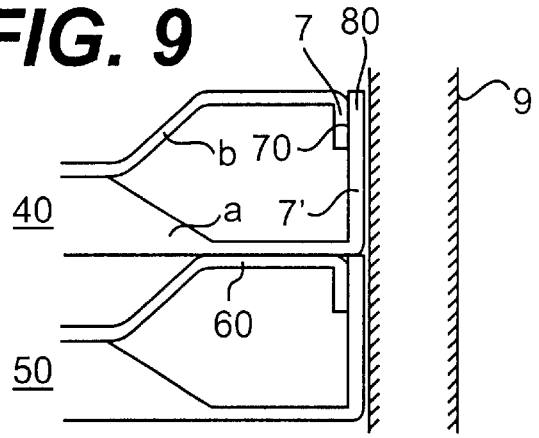
FIG. 9 is a cross-sectional view of FIG. 8 taken through line 9—9 showing the platform zone with the edges of the headers fixed to core face on the platform.
Figure 10:
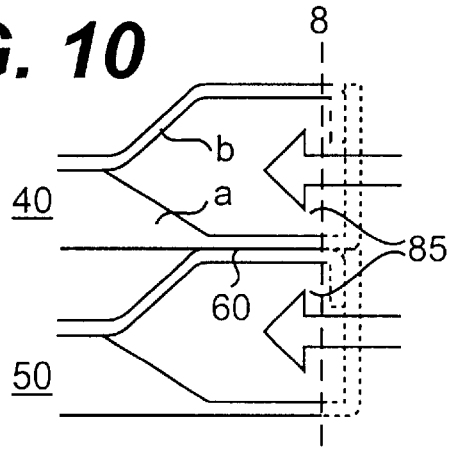
FIG. 10 is a cross-sectional view of FIG. 8 taken through line 10—10 showing the openings for heat transfer fluid to enter and/or exit the heat exchanger through one of the core faces.
Figure 11:
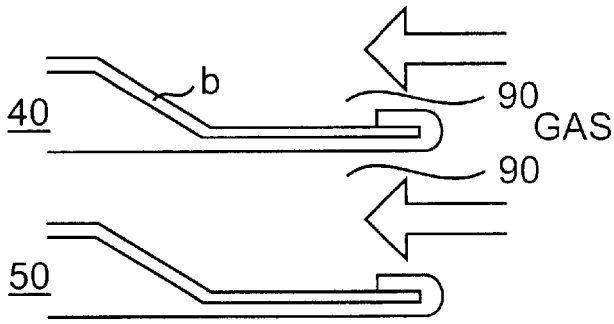
FIG. 11 is a cross-sectional view of FIG. 8 taken through line 11—11 showing the flattened sections of the joined sheet pairs that form gaps to allow heat transfer fluid to enter and/or exit the heat exchanger through one of the core faces.

As shown by FIGS. 8–11, a pattern of three alternating angular sector configurations occurs on the faces of core 1 by providing regions of side wall 80 which have been alternately cut, left intact, and flattened. FIGS. 9–11 show cross-sectional perspectives of FIG. 8 taken through lines 9—9, 10—10, and 11—11, with only two adjacent pairs of sheets a and b (referred to as coil stacks) 40 and 50 illustrated. Referring to FIGS. 8 and 10, in a region 100 an opening 85 is cut into side wall 80. This cutting essentially removes the bent portions of sheets a and b as shown by the dotted lines in FIG. 10. Opening 85, resulting from cutting away side wall 80, creates an angular sector that serves as an inlet and/or outlet on the faces of core 1 to allow a heat transfer fluid to enter and/or exit the heat exchanger. In the embodiment and view of the heat exchanger shown, air is passed in through openings 85, though other heat transfer fluids are contemplated by the invention as well.

In region 200 shown from a top view of the core face in FIG. 1 and shown by the cross-sectional view taken through line 9—9 in FIG. 8, side wall 80 created by bent, folded, and connected edges 7 and 7' is left intact. By leaving side wall 80 intact, coiling stacks form an angular sector providing a continuous, flat surface well-suited for the attachment of an external header 8. The edges of header 8 are shown by the dotted lines in FIG. 8 and by edge wall 9 in FIG. 9.

Finally, in region 300 shown in FIGS. 8 and 11, side wall 80 is flattened. FIG. 11 best illustrates the configuration of sheets a and b after side wall 80 has been flattened and coiling stacks 40 and 50 formed. The flattening of side wall 80 in this way creates a gap 90, and these adjacent gaps create a passage for the second heat transfer fluid to enter and exit the heat exchanger. In the embodiment shown, the second heat transfer fluid is a gas, however, any heat transfer fluid is considered within the scope of the present invention. The seam-welded and flattened edge results in a passage that effectively seals the gas, or other heat transfer fluid, from leaking out.

The pattern of cutting, leaving intact, and flattening results in alternating cut-open, platform, and flattened side wall angular sectors. These respective sectors align in the radial direction of heat exchanger core 1. In regions 100 and 200, adjacent coil stacks are joined together at 60, as shown in FIGS. 9 and 10. Preferably joining the stacks occurs by seam-welding, however any other suitable joining mechanism can be used that is capable of withstanding the pressures occurring within the heat exchanger. In region 300, coil stacks are not joined together.

Figure 12:
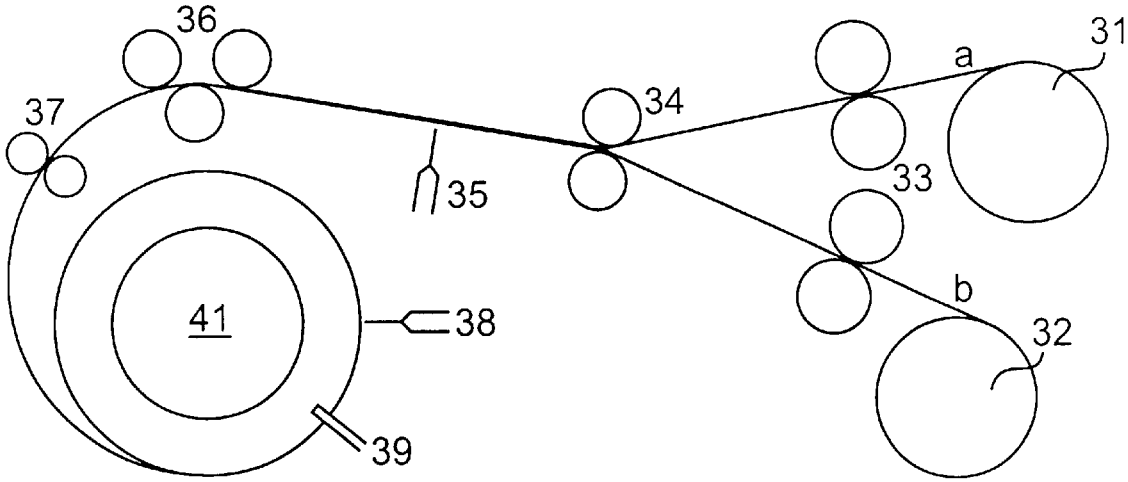
FIG. 12 is a perspective, schematic view of an embodiment of an overall processing and coiling system for forming the heat exchanger core according to the present invention.

FIG. 12 illustrates an embodiment of an overall forming and coiling process of heat exchanger core 1 according to the present invention. First, each sheet a and b forming the stacked pair of sheets is fed from a respective feeder 31 and 32. From feeders 31 and 32, sheets a and b are corrugated in corrugating rollers 33. The corrugations are formed in zones II–IV as described with reference to FIGS. 4 and 5. That is, corrugations are formed in a direction transverse to sheet a along its length and longitudinal to sheet b along its length.

From corrugating rollers 33, sheets a and b are passed through a roller 34 that aligns the sheets for seam welding along their edges, and dot welding on their contact points 11 if necessary, at welding station 35. The 40 resulting joined pair of sheets a and b proceeds to bending rollers 36 where edges 7 and 7' are bent to form side wall 80. After side wall 80 has been formed, the sheet pair continues on to flattening rollers 37 where portions of the side wall of the pair of sheets corresponding to the gas passages are flattened. As each section that requires flattening passes through flattening rollers 37, the length of side wall 80 subject to flattening increases so that the proper angular sectors are formed upon coiling of sheets a and b.

From flattening rollers 37, the sheet pair winds around rotating mandrel 41 where a welding station 38 is disposed to weld adjacent coil stacks together at the zones corresponding to the cut-open and platform zones. Finally, after rotating mandrel 41 coils the pair of sheets a and b so as to form heat exchanger core 1, a cutting tool 39 removes side wall 80 at appropriate angular sectors to form the openings for a heat transfer fluid, as discussed above. Cutting the openings into side wall 80 after the heat exchanger core has been formed essentially eliminates buckling of the edges defining the opening. Such buckling is prevalent when the openings are cut prior to coiling the sheets. Cutting the openings can also take place after the complete coiling of the heat exchanger core by milling or electro-erosion, for example, or other like suitable techniques.

It will be apparent to those skilled in the art from consideration of the specification and practice of the invention disclosed herein that various modifications and variations can be made in embodiments of the coiled heat exchanger according to the present invention. For example, though air and gas were disclosed as the heat transfer fluids used in the heat exchanger, other heat transfer fluids can be used in the heat exchanger and are contemplated to be within the scope of the invention. Additionally, the connection of the various parts of the heat exchanger, such as, for example, the connection of the header to the core, the connection of sheets a and b, and the connection of adjacent coil stacks, can occur through means other than welding or brazing. It is important that the connections withstand the various conditions, such as temperature and pressure, that occur during the operation of the heat exchanger, however suitable methods would be apparent to those skilled in the art.

Therefore, the invention in its broader aspects is not limited to the specific details and illustrative examples shown and described in the specification. It is intended that departures may be made from such details without departing from the true spirit or scope of the general inventive concept as defined by the following claims and their equivalents.

What is claimed is:

1. A heat exchanger formed by coiling a pair of sheets, comprising:

a first sheet having an edge; and a second sheet having an edge, said second sheet connected to said first sheet along their respective edges such that said edges form a substantially flat wall, and wherein said wall formed by connecting said first and second sheet edges includes a first set of openings formed by cutting the wall and a second set of openings formed by flattening the wall.

2. The heat exchanger of claim 1, wherein said wall further includes a set of platforms formed by leaving the wall intact.

3. The heat exchanger of claim 1, wherein the first and second sheets are coiled to form an essentially cylindrical core, wherein two walls are formed by connecting the edges of the sheets and said two walls form faces of the core.

4. The heat exchanger of claim 3, wherein said first set of openings and said second set of openings form angular sectors along faces of the core.

5. The heat exchanger of claim 4, wherein said wall further includes a set of platforms formed by leaving the walls intact.

6. The heat exchanger of claim 5, wherein said first set of openings, said second set of openings, and said set of platforms form a pattern of alternating angular sectors around a longitudinal axis of the core.

7. The heat exchanger of claim 2, wherein headers are configured to be disposed on the platforms.

8. The heat exchanger of claim 1, wherein said first and second sets of openings are configured for receiving respective first and second heat transfer fluids.

9. The heat exchanger of claim 1, wherein the sheets are coiled to form a cylindrical core and the first set of openings are cut into the side walls after the core is formed.

10. The heat exchanger of claim 1, wherein the first sheet includes ripples extending in a direction substantially parallel to a longitudinal axis of the heat exchanger.

11. The heat exchanger of claim 1, wherein the second sheet includes ripples extending in a direction substantially perpendicular to the longitudinal axis of the heat exchanger.

12. The heat exchanger of claim 1, wherein ripples are disposed on surfaces of the first and second sheets that abut each other when connected together, said ripples configured to form a distribution zone near the edges of the sheets and a substantially longitudinal flow zone between the edges.

13. The heat exchanger of claim 12, wherein heat transfer fluids passing through the heat exchanger flow in a cross-flow manner within in the distribution zone and a counter-flow manner in the longitudinal flow zone.

14. The heat exchanger of claim 1, wherein the first and second sheets are coiled to form a cylindrical core and adjacent coils of the core are welded together in a region of the core that includes the cut-open wall and in a region of the core that includes the platform.

15. A method for forming a coiled heat exchanger, comprising:

providing a first sheet and a second sheet;

connecting said sheets to each other along edges of the sheets such that the edges form a substantially flat wall between surfaces of the sheets;

reducing a thickness of the wall at intervals along the length of the connected sheets;

coiling the sheets to form a core, said core having a face formed by the wall; and removing portions of the wall on the face of the core.

16. The method of claim 15, further comprising leaving portions of the wall intact along the length of the connected sheets such that platforms are formed on the face of the core.

17. The method of claim 16, wherein the removing, the leaving intact, and the reducing the thickness of portions of the wall includes forming alternating angular sectors of cut-open sectors, platform sectors, and gap-forming sectors on the core face.

18. The method of claim 15, wherein connecting the edges to form the wall includes bending the edges.

19. The method of claim 15, wherein reducing the thickness of the wall forms gaps between adjacent coils.

20. The method of claim 15, wherein reducing the thickness of the wall includes flattening the wall.

21. The method of claim 15, wherein removing portions of the wall includes cutting the wall.

22. The method of claim 15, wherein the removed wall portions and the reduced thickness wall portions each form angular sectors on the face of the coiled core, said angular sectors configured to pass heat transfer fluid therethrough.

23. The method of claim 15, further comprising providing ripples on each of the first and second sheets and connecting the sheets such that crests of the ripples on each sheet are in contact with one another.

24. The method of claim 23, wherein ripples on the first sheet extend substantially parallel to the longitudinal axis of the core and ripples on the second sheet extend substantially perpendicular to the longitudinal axis of the core.

25. The method of claim 24, wherein the ripples are formed by corrugating each sheet prior to connecting the sheets.

26. The method of claim 15, further comprising fixedly connecting adjacent coils, the coils being formed by coiling the first and second sheets, in regions corresponding to the removed wall portions and the intact wall portions.

27. The method of claim 26, wherein fixedly connecting the adjacent coils includes seam-welding the adjacent coils.

28. The method of claim 15, wherein coiling the sheets to form said core includes forming a cylindrical core.

* * * * *